United States Patent [19]

Franke

[11] 4,359,245

[45] Nov. 16, 1982

[54] CHAIR-RECLINER

[76] Inventor: Thomas A. Franke, 224 Hill St., Hartland, Wis. 53029

[21] Appl. No.: 165,242

[22] Filed: Jul. 2, 1980

[51] Int. Cl.[3] ..... A47C 3/00

[52] U.S. Cl. ..... 297/284; 297/456; 297/457

[58] Field of Search ..... 297/456, 455, 457, 452, 297/DIG. 1, 284; 267/109

[56] References Cited

U.S. PATENT DOCUMENTS

| | | | |
|---|---|---|---|
| 280,004 | 6/1883 | Bakewell | 297/284 X |
| 1,980,551 | 11/1934 | Ross | 297/284 |
| 2,124,655 | 7/1938 | Fround | 297/456 X |
| 3,049,730 | 8/1962 | Wall et al. | 297/455 X |
| 3,188,142 | 6/1965 | Probst | 297/456 |
| 3,241,879 | 3/1966 | Castello et al. | 297/284 |
| 3,476,497 | 11/1969 | Cashen et al. | 297/455 |
| 3,495,874 | 2/1970 | Dean | 297/DIG. 1 |
| 3,642,323 | 2/1972 | Taylor | 297/DIG. 1 |
| 3,967,852 | 7/1976 | Eiselt et al. | 297/455 X |
| 4,052,104 | 10/1977 | Noss | 297/456 |

FOREIGN PATENT DOCUMENTS

| | | | |
|---|---|---|---|
| 209160 | 1/1924 | United Kingdom | 267/109 |

*Primary Examiner*—Francis K. Zugel
*Attorney, Agent, or Firm*—Robert C. Sullivan

[57] ABSTRACT

An article of furniture adapted to be used selectively as a chair or as a recliner, and which is particularly suitable for use by arthritics or others who because of infirmity have difficulty in becoming seated in or arising from an article of furniture such as a chair or a recliner. The chair-recliner includes a supporting framework and a chair-recliner body mounted on the framework. The chair-recliner body comprises a deformable resilient member which extends for the length of the chair-recliner body, the resilient member being connected to its opposite longitudinal ends to the framework. The length of the resilient member exceeds the distance between the locations at which the ends thereof are connected to the framework, whereby the resilient member assumes a normally vertically extending arch-like arcuate shape when the chair-recliner body and the resilient member which forms a part thereof are in an "at rest" predeformation position. The arch-like arcuate predeformation shape of the chair-recliner body facilitates the movement of an infirm person into seated or reclining position. The chair-recliner body and the resilient member are deformable by the body weight of a user from the arch-like arcuate predeformation shape selectively into a chair shape or into a recliner shape in accordance with the positioning of the user's body weight on the chair-recliner body. The movement of the chair-recliner body into deformed position corresponding to the seated or to the reclining position of the chair-recliner stores energy in the deformable resilient member of the chair-recliner body, which aids the user in arising from the chair-recliner when desired. A suitable latching means is provided to retain the deformable body of the chair-recliner in its deformed position, such as the seated or reclining position, to prevent unintentional reversion of the chair-recliner body to its predeformation position. The latching means is released when the user desires to arise from the chair-recliner.

8 Claims, 11 Drawing Figures

SITTING POSITION

RECLINING POSITION

CHAIR-RECLINER

BACKGROUND OF THE INVENTION

1. Field of the Invention

This invention relates to an article of furniture which can be used selectively as a chair or as a recliner, and more particularly, to an article of furniture of this type which, while not restricted thereto, is particularly suitable for use by persons, such as arthritics or others who because of infirmity have difficulty becoming seated in or arising from an article of furniture such as a chair or a recliner.

2. Description of the Prior Art

It has been known in the prior art to provide seating units such as chairs or the like which conform to the body shape of the occupant.

The following U.S. Pat. Nos. are illustrative of seating units of the type just mentioned;

3,476,497 issued to Terry F. Cashen et al on Nov. 4, 1969

3,495,874 issued to William Roger Dean on Feb. 17, 1970

3,642,323 issued to William Paul Taylor on Feb. 15, 1972

4,052,104 issued to William N. Noss on Oct. 4, 1977.

STATEMENT OF THE INVENTION

It is an object of the present invention to provide an article of furniture embodying a seating or reclining unit which, while not restricted thereto, is particularly adapted for use by persons who have difficulty becoming seated in or arising from an article of furniture such as a chair or a recliner.

It is a further object of the invention to provide an article of furniture which may be selectively used as a chair or as a recliner and which is inexpensive to manufacture.

It is a further object of the invention to provide an article of furniture which may be used selectively as a chair or as a recliner and which is deformed by the occupant of the article of furniture upon becoming seated or reclining therein, and in which the article of furniture has a predeformation shape which aids the user in becoming positioned on the seating or reclining unit.

It is a further object of the invention to provide an article of furniture which may be used selectively as a chair or as a recliner and in which the user, in moving to seated or reclining position in the chair-recliner, stores energy therein which aids the user in arising from the chair-recliner when desired.

In achievement of these objectives, there is provided in accordance with the invention an article of furniture adapted to be used selectively as a chair or as a recliner, comprising a supporting framework and a chair-recliner body mounted on said framework, said body comprising a deformable resilient member, means connecting the opposite longitudinal ends of said resilient member to said framework, the length of said resilient member exceeding the distance between the locations at which said ends are connected to said framework, whereby said resilient member assumes a normally vertically extending arch-like arcuate shape when said body member and said resilient member are in an "at rest" predeformation position, said body member and said resilient member being deformable by the weight of a user from said arch-like arcuate shape selectively into a chair shape or into a recliner shape in accordance with the positioning of the user's body weight on said chair-recliner body. A further feature of the construction is the provision of latching means to retain the chair-recliner body member in a deformed position corresponding to the chair shape or to the recliner shape to prevent unintentional reversion of the chair-recliner body to the predeformation shape.

BRIEF DESCRIPTION OF THE DRAWINGS

Further objects and advantages of the invention will become apparent from the following description taken in conjunction with the accompanying drawings in which.

DESCRIPTION OF THE PREFERRED EMBODIMENT

Figure 1:
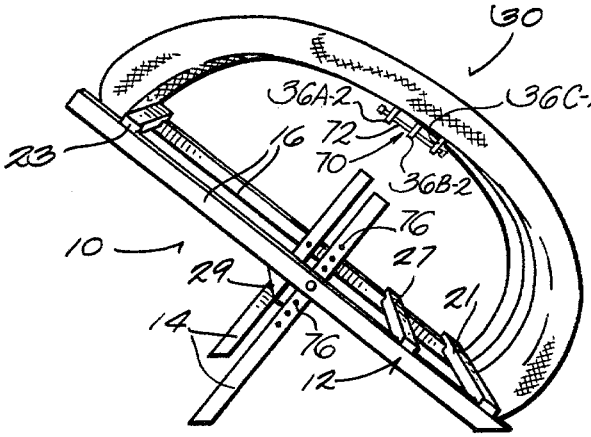
FIG. 1 is a perspective view of the chair-recliner of the invention in its "at rest" or predeformation position.

Referring now to the drawings, and more particularly to FIGS. 1 and 6–8, inclusive, there is shown a chair-recliner generally indicated at 10 comprising a supporting framework generally indicated at 12 which may be made of wood or other suitable material. Framework 12 includes a pair of laterally spaced inclined leg members 14 and a pair of laterally spaced side frame members 16 which are rigidly secured intermediate of their length to leg members 14 at an intermediate portion of the height of the leg members 14. The lower ends of the spaced side frame members 16 are connected together by a crosspiece 21 by means of bolts 22 which extend through crosspiece 21 and through side frame members 16. An upper crosspiece 23 is secured by bolts 25 to the laterally spaced side frame members 16 contiguous the upper ends of members 16. Upper crosspiece 23 may be adjustably positioned relative to the upper ends of side frame members 16 to permit adjustment of the tension of the spring assembly 32, as will be explained hereinafter.

One or more additional cross-members such as that indicated at 27 in FIG. 1 may be connected between side frame members 16 at one or more spaced locations along frame structure 12 to provide additional structural strength to frame 12. A cross-member 29 is connected at its opposite ends to the two leg members 14 beneath the respective side frame members 16. In addition to serving the function of structurally reinforcing frame 12, cross-members 27 and 29 serve the additional function of serving as limiting abutments which limit the downward movement of chair-recliner body 30.

Figure 2:
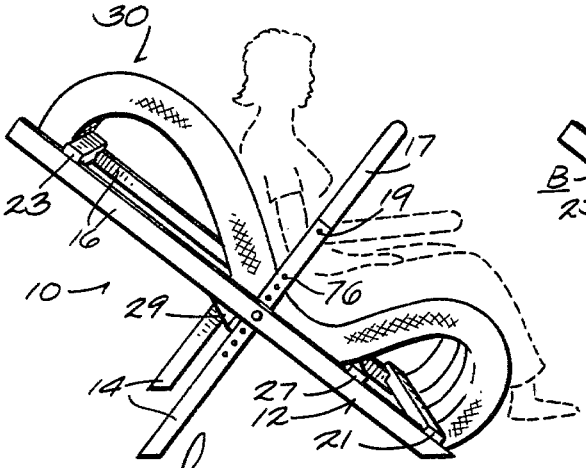
FIG. 2 is a perspective view of the chair-recliner of FIG. 1 when in use as a chair.

A pair of arms 17 are pivotally connected at 19 to the upper ends of the two leg members 14, as shown in FIG. 2. In order to simplify the drawings, arms 17 are not shown in the views of FIGS. 1, 3 and 6. When chair-recliner 10 is in the "at rest" or predeformation position shown in FIG. 1, arms 17 are raised and in alignment with the axis of the respective legs 14 as shown in full line in the view of FIG. 2. When the arms 17 are in the full line position of FIG. 2, they may be grasped by the user of the chair to aid him as he is moving into seated, or alternatively, into reclining position. When the occupant of the chair is in the seated position of FIG. 2 or in the reclining position of FIG. 3, arms 17 may be swung about their pivotal connection 19 to the dotted line position of FIG. 2 where they will serve as arm rests for the occupant of the chair. Suitable detent means (not shown) are provided to hold arms 17 in either the elevated full line position of FIG. 2 or in the horizontal dotted line position of FIG. 2, as desired.

Frame structure 12 supports a deformable chair-recliner body generally indicated at 30 which comprises a resilient means in the form of a metal spring assembly generally indicated at 32 which lies at the radially inner portion of the body 30, a padding 34 which may be of a suitable plastic foam material or the like, and an upholstery fabric 40 which suitably covers chair-recliner body 30.

Figure 6:
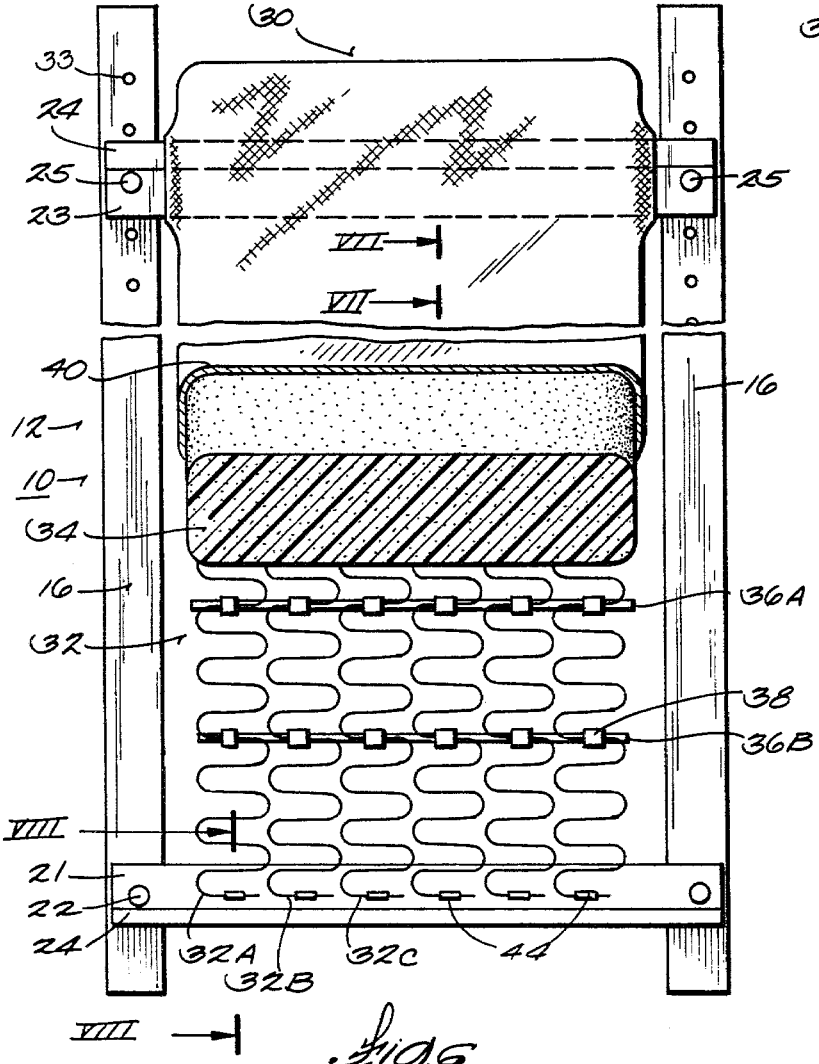
FIG. 6 is a view partially in top plan and partially in section of the chair-recliner showing details of the spring construction of the chair-recliner, the legs of the chair-recliner being omitted in this view.

As best seen in the view of FIG. 6, the spring assembly generally indicated at 32 comprises a plurality of serpentine or zig-zag springs 32A, 32B, 32C, etc., which extend for the entire length of spring assembly 32. The plurality of springs 32A, 32B, etc. are held in assembled relation with respect to each other by spring steel rods such as those shown at 36A and 36B which extend in a direction transversely of the longitudinal axis of spring assembly 32 in spanning relation to the plurality of side-by-side zig-zag springs 32A, 32B, etc. The spring steel rods 36A, 36B are secured to the rows of springs 32A, 32B, etc. by means of clips 38. In addition, contiguous portions of different springs such as the springs 32A, 32B, are connected together by wire loops.

Springs of the zig-zag or serpentine type are well known in the upholstery art and are sold commercially by No-Sag Spring Company, a subsidiary of Lear Siegler, Inc., 3500 West 11 Mile Road, Berkley, Mich. 48072.

In order to provide a comfortable support for the user of the chair-recliner, the padding 34, which may be made of polyurethane foam, for example, and typically may be four inches in thickness, rests on and is supported by spring assembly 32, padding 34 extending for the entire length of the chair-recliner body 30. The upholstery fabric 40 covers the radially outer surface of foam padding 34 and also suitably encloses the side walls and ends of chair-recliner body 30. The upholstery fabric 40 is wrapped around chair-recliner body 30 in such manner as to enclose at least a portion of the radially inner or under surface of body 30 in underlying relation to spring assembly 32.

In accordance with the invention, and as best seen in the view of FIG. 1, the chair-recliner body 30, including spring assembly 32, is mounted on frame structure 12 in such manner that the body 30, including spring assembly 32, assumes an arcuate or arch shape when the chair-recliner is not in use--that is, when the chair-recliner is in the "at rest" or predeformation position shown in FIG. 1. This is accomplished by having the resilient component of body 30, namely, spring assembly 32 in the embodiment of FIGS. 6–8, inclusive, of a predetermined greater length than the lengthwise dimension between the locations A and B at which the opposite ends of spring assembly 32 are anchored to frame 12 of chair-recliner 10.

Figure 8:
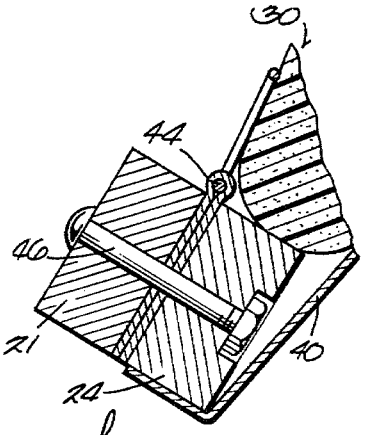
FIG. 8 is a view in section taken along line VIII—VIII of FIG. 6.

In the illustrated embodiment, as best seen in FIG. 1, one end of body 30, including spring assembly 32 is anchored at location A at the lower end of chair-recliner frame 12 while the opposite end of body 30, including spring assembly 32, is anchored at location B contiguous the upper end of frame assembly 12. In the illustrated embodiment, the connection of chair-recliner body 30 to the lower end of frame 12 at location A is fixed. This is due to the fact that the lower cross-member 21, to which the lower end of chair-recliner body 30, including spring assembly 32, is secured, is fixed in a non-adjustable position to side frame members 16 by bolts 22 (FIG. 6). As best seen in the views of FIGS. 6 and 8, the ends of the plurality of spring members 32A, 32B, etc. are secured to cross-piece 21 by clip members 44. Additionally, the ends of the plurality of spring members 32A, 32B, etc. are sandwiched between cross-member 21 and a board-like retainer member 24 which is secured by bolts 46 to the forward surface of cross-member 21 (see FIG. 8).

At the upper end of the chair-recliner assembly, the chair-recliner body 30, including spring assembly 32, is suitably secured to cross-member 23 by clips 44, and the ends of springs 32A, 32B, etc. are sandwiched between upper cross-member 23 and a board-like retainer member 24' similar to member 24 and which is secured by bolts or the like (not shown) to the rearward surface of cross-member 23 (FIG. 8), all in a manner similar to that shown in FIGS. 6 and 8 for the connection of the spring assembly at the lower end of the chair-recliner.

Cross-member 23 is adjustably mounted on frame 12 by means of bolts 25 which pass through cross-member 23 and through side frame members 16 of frame structure 12. A plurality of holes or passages 33 are provided at spaced points contiguous the upper end of each of the side frame members 16 to permit cross-member 23 to be selectively positioned at any one of a plurality of desired positions contiguous the upper end of frame 12, thereby varying location B at which the upper end of chair-recliner body 30 is anchored. By varying location B, the tension on the resilient component of body 30, namely, spring assembly 32, may be varied to accommodate persons of different weights who may have occasion to make use of the chair-recliner.

Chair-recliner body 30 is preferably adjustably secured to framework 12 at the location B contiguous the upper end of framework 12, with the lower end of body 30 being fixedly connected to framework 12 at location A contiguous the normally lower end of framework 12, as previously described and as shown in the drawings.

Chair-recliner body 30 can also instead be adjustably secured to framework 12 at location A, contiguous the lower end of framework 12, while the upper end of body 30 is non-adjustably secured to framework 12 contiguous the normally upper end of framework 12. It is also possible to have both ends of body 30 adjustably secured to framework 12.

In mounting chair-recliner body 30, including spring assembly 32, on the chair-frame 12, it is necessary to flex or bow spring assembly 32 to cause spring assembly 32 and the chair-recliner body 30, of which spring assembly 32 forms a part, to assume the arcuate or arched shape shown in FIG. 1 corresponding to the "at rest" or predeformation position of body 30, since the unflexed length of spring assembly 32 and of body 30 prior to assembly on frame 12, is of greater length than the distance between the locations A and B at which the lower and upper ends of spring assembly 32 are anchored.

When the chair-recliner is in the "at rest" predeformation position of FIG. 1, it can be seen that the upwardly arched contour of the chair-recliner body 30 provides and elevated surface for initial engagement by the user, such as an arthritic or otherwise infirm person, which facilitates the movement of the user of the chair-recliner from an initial upright position of the user selectively into a seated or into a reclining position.

Figure 3:
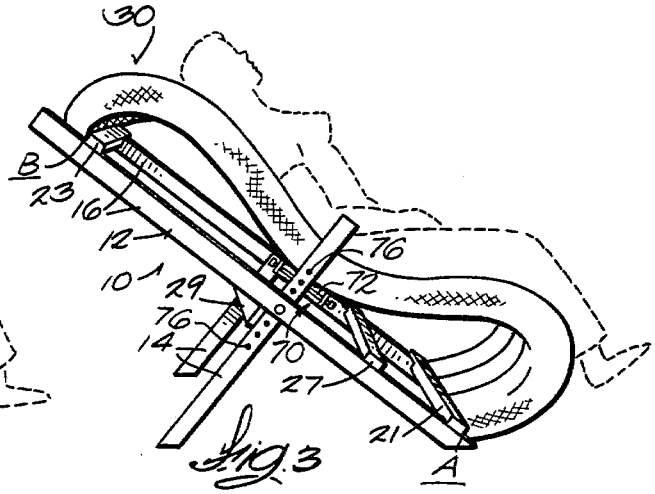
FIG. 3 is a perspective view of the chair-recliner of FIGS. 1 and 2 when in use as a recliner.
Figure 4:
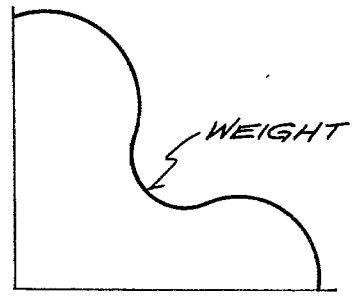
FIG. 4 is a diagrammatic side view of the chair-recliner when being used as a chair.
Figure 5:
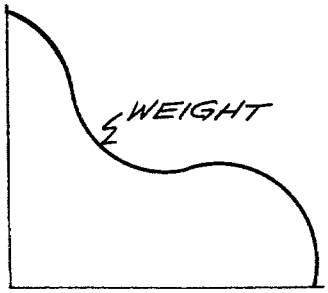
FIG. 5 is a diagrammatic side view of the chair-recliner when being use as a recliner.

When the user of the chair applies body weight to the chair-recliner along a directional line as diagrammatically shown in FIG. 4, the chair-recliner body 30, including resilient spring assembly 32, is deformed inwardly to the chair position shown in FIGS. 2 and 4; or alternatively, chair-recliner body 30 is deformed to the recliner position shown in FIGS. 3 and 5 when the user's body weight is applied along a directional line such as that shown diagrammatically in FIG. 5.

When the chair-recliner 10 is being used either as a chair ( as in FIGS. 2 and 4) or as a recliner (as in FIGS. 3 and 5), the deformation of chair-recliner body 30, including spring assembly 32, from the "at rest" or predeformation position of FIG. 1 to the deformed positions of chair-recliner body 30 corresponding either to the sitting position or to the reclining position causes energy to be stored in the resilient component of body 30, namely, in spring assembly 32; and this stored energy facilitates the arising movement of the user of the chair-recliner 10 out of the seated position or out of the reclining position. When the user of the chair-recliner arises therefrom, body 30 of the chair-recliner returns to the arcuate or arch-like predeformation shape shown in FIG. 1 due to the resiliency of spring assembly 32.

Figure 7:
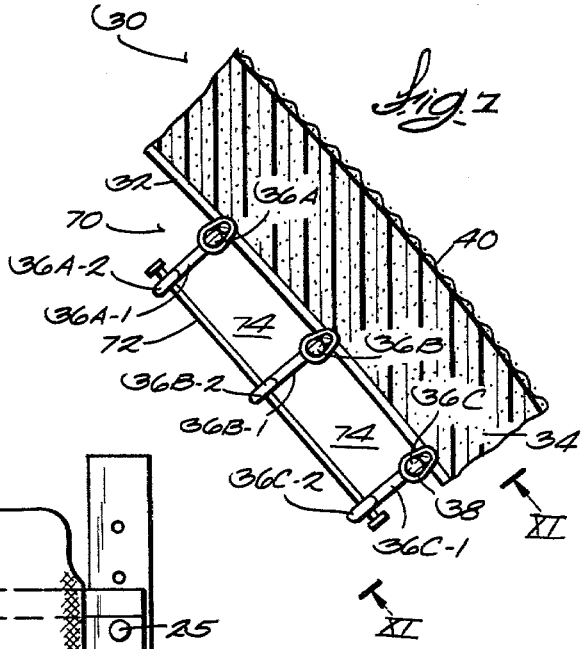
FIG. 7 is a view taken in section along line VII—VII of FIG. 6.
Figure 11:
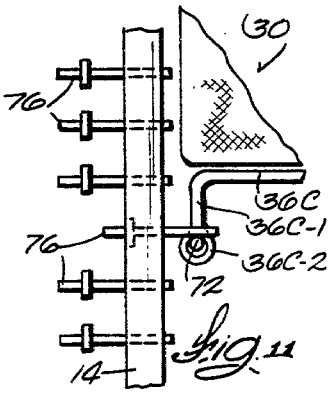
FIG. 11 is a view taken in section along line XI—XI of FIG. 7 and showing the chair-recliner body in downwardly locked position to prevent unintended reversion of the chair-recliner body to its predeformation shape.

A further feature of the construction, as best seen in FIGS. 7 and 11, is the provision of a locking or latching arrangement generally indicated at 70 to retain chair-recliner body 30 in the deformed position of either FIG. 2 or 3 to prevent unintended reversion of the chair-recliner body 30 to the predeformation shape of FIG. 1.

To provide the latching arrangement 70, the laterally outer ends of a plurality of the cross rods 36A, 36B, etc. of spring assembly 32 in the general region of legs 14 are respectively provided with a downwardly projecting right angle bend as indicated at 36A-1, 36B-1, etc., and the lower end of each of the downwardly projecting portions 36A-1, 36A-2, etc. is turned upon itself to form a ring portion indicated at 36A-2, 36B-2, etc. A spring steel rod 72 extends through and is suitably mounted on the plurality of ring portions 36A-2, 36B-2, etc., with rod 72 extending in underlying relation to spring assembly 32 for a portion of the length of chair-recliner body 30 in the region of leg members 14. A locking arrangement 70 similar to that just described is provided on each side of chair-recliner body 30. The rod 72, which is secured to spring assembly 32 in the manner just described, defines a space or "latching area" such as that indicated at 74 which is bounded at the radially outer or upper portion thereof by spring assembly 32 and at the radially inner or under portion thereof by rod 72.

A plurality of pins or plunger members indicated at 76 (FIG. 11) are slidably mounted in passages 78 in each of the leg members 14, and when it is desired to latch or lock chair-recliner body 30 in a predetermined position, such as the seated position of FIG. 2 or the reclining position of FIG. 3, a plunger member 76 at the proper height is pushed laterally inwardly on each side of chair-recliner 10 to engage the corresponding latching area 74 which is bounded by the lower surface of spring assembly 32 and by rod member 72. When plunger members 76 are in their actuated latching position, they are in overlying relation to rod 72 attached to spring assembly 32, and thus latch chair-recliner body 30 in a downward position corresponding either to the chair position (FIG. 3) or to the recliner position (FIG. 4).

When the user of chair-recliner 10 desires to rise from the chair-recliner, the pin or plunger members 76 may then be pulled or actuated laterally outwardly and out of the latching area 74 to thereby permit chair-recliner body 30 to return to the "at rest" or predeformation position shown in FIG. 1.

Since the components of the latching device 70 including the downwardly projecting portions 36A-1, 36B-1, etc. of cross rods 36A, 36B, etc., and the rod 72 are all made of spring steel, the latching device 70 will bend or flex along with spring assembly 32 when body 30 of the chair assumes the various positions such as those shown in FIGS. 1, 2 and 3 of the drawings.

It can be seen that the chair-recliner of the invention, while not restricted thereto, has particular utility for use by persons who have difficulty in becoming seated in or arising from an article or furniture such as a chair or recliner. Such persons may be, for example, arthritics or persons who are otherwise infirm and have difficulty in becoming positioned in or arising from a chair or recliner.

While the resilient component of the chair-recliner assembly has been illustrated as embodied in a spring assembly 32, other suitable resilient means may be incorporated in chair-recliner body 30 in place of the spring assembly 32 hereinbefore described. Thus, the resilient component of body 30 may be a sheet of acrylic plastic, which is a shortened and common name for polymers of methyl methacrylate. This acrylic plastic material is produced by several companies under different trademarks, including the trademark PLEXIGLAS of Rohm and Haas Company, ACRYLITE of CY/RO Industries, and LUCITE of E. I. DuPont de Nemours & Company.

As shown in the sectional view of FIG. 9, the sheet 50 of acrylic plastic material is substituted in place of spring assembly 32 in a chair-recliner body 30' which is otherwise similar to that shown in FIGS. 1–8, inclusive, of the drawings and hereinbefore described, and which would include foam padding 34' and upholstery fabric 40' in a manner similar to that shown and described in connection with the embodiment of FIGS. 1–8, inclusive. The sheet 50 of acrylic plastic material would have a greater length than the distance between the locations contiguous the upper and lower ends of chair-recliner 10 at which the opposite ends of plastic sheet 50 are attached to the framework of chair-recliner 10. Hence, plastic sheet 50 must be bowed into an arcuate or arch-like predeformation shape such as that shown in FIG. 1 in order to connect plastic sheet 50 to framework 52, as previously described in connection with the embodiment of FIGS. 1–8, inclusive.

Figure 10:
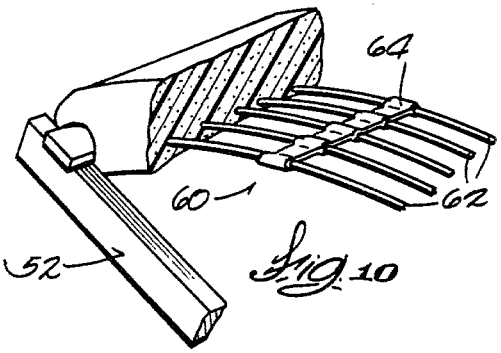
FIG. 10 is a fragmentary view showing the upper portion of a chair-recliner in accordance with a modified embodiment of the invention and which uses an alternate form of spring assembly.

There is shown in FIG. 10 another modified embodiment in which a different type of spring assembly is used in place of the spring assembly 32 shown in FIGS. 6, 7, and 8. In FIG. 10, a spring assembly generally indicated at 60 is provided and includes a plurality of round cross section spring steel rods 62 which are spaced apart laterally from each other by a short distance. Rods 62 are suitably connected at their opposite ends to locations at the lower and upper ends of a framework generally indicated at 52 which may be similar to that shown and described in connection with the embodiment of FIGS. 1–8, inclusive. Rods 62 are held in assembled interconnected relation with each other by suitable means such as nylon cording, nylon webbing, or the like, indicated at 64.

The spring steel rods 62 are of greater length than the distance between the locations at which their opposite ends are attached to framework 52. Hence, spring assembly 60 must be bowed into an arcuate of arch-like predeformation shape such as that shown in FIG. 1 in order to connect the opposite ends of spring assembly 60 respectively to the upper and lower ends of framework 52, as previously described in connection with the embodiment of FIGS. 1–8, inclusive.

Figure 9:
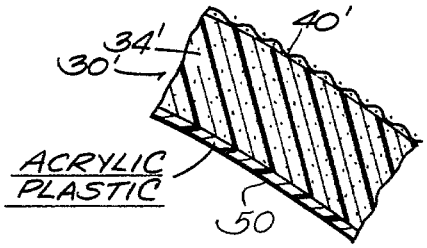
FIG. 9 is a view taken along a section line similar to line VII—VII of FIG. 6 but showing the use of a different type of resilient member than that used in the embodiment of FIG. 6.

The modified arrangements shown in FIGS. 9 and 10 using different types of resilient members for chair-recliner body 30, such as the acrylic plastic sheet 50 of FIG. 9 or the spring steel rods 62 of FIG. 10, may be provided with a latching arrangement generally similar to that shown in FIGS. 7 and 11 to latch the chair-recliner body in the deformed shapes shown in FIG. 2 and FIG. 3 against unintended reversion to the predeformation position of FIG. 1.

With further reference to the embodiment of the invention shown in FIG. 9, a still further modified chair body may be provided in which foam padding 34' and upholstery fabric 40' are not used, and the chair body includes only the sheet of acrylic plastic material 50.

The operating characteristics of the chair-recliner, and particularly of the body 30 thereof, are substantially the same for all of the various embodiments described hereinbefore and shown in the drawings.

From the foregoing detailed description of the invention, it has been shown how the objects of the invention have been obtained in a preferred manner. However, modifications and equivalents of the disclosed concepts such as readily occur to those skilled in the art are intended to be included within the scope of the invention.

The embodiments of the invention in which an exclusive property or privilege is claimed are defined as follows:

1. An article of furniture adapted to be used selectively as a chair or as a recliner, comprising a vertically inclined supporting framework including a normally lower end and a normally upper end, leg means carried by said framework for supporting said framework in vertically inclined position, a chair-recliner body mounted on said framework, said body comprising a deformable resilient member, means connecting the respective opposite longitudinal ends of said deformable resilient member to said framework at locations respectively contiguous said normally lower end and contiguous said normally upper end of said framework, the length of said resilient member exceeding the distance between said locations at which said ends of said resilient member are connected to said framework, whereby said body and said resilient member assume a normally vertically extending arch-like arcuate shape when said body and said resilient member are in an "at rest" predeformation position, said body and said resilient member being deformable by the weight of a user from said arch-like arcuate shape selectively into a chair shape or into a recliner shape in accordance with the positioning of the user's body weight on said chair-recliner body.

2. An article of furniture as defined in claim 1 in which said resilient member is a spring assembly.

3. An article of furniture as defined in claim 2 in which said spring assembly comprises a plurality of individual springs, said individual springs respectively extending in a direction lengthwise of the respective springs from contiguous the normally upper end of said framework to contiguous the normally lower end of said framework, means interconnecting said plurality of individual springs in assembled relation to each other, and means anchoring said spring assembly to said framework contiguous said normally upper end of said framework and contiguous said normally lower end of said framework.

4. An article of furniture as defined in claim 3 in which said plurality of individual springs are of the serpentine or zig-zag type.

5. An article of furniture as defined in claim 3 in which said plurality of individual springs are rods of spring steel.

6. An article of furniture as defined in claim 1 in which said resilient member comprises a sheet of acrylic plastic material.

7. An article of furniture as defined in claim 1 in which an end of said resilient member is adjustably connected to said framework whereby to permit varying the tension on said resilient member.

8. An article of furniture as defined in claim 1, including latching means comprising cooperating elements mounted on said framework and on said chair-recliner body, said cooperating elements being engageable with each other when said chair-recliner body is in a deformed position corresponding either to the seated or to the reclining position of said chair-recliner body, whereby to retain said chair-recliner body in said deformed position against unintentional reversion to said predeformation position.

* * * * *